US010744758B2

(12) United States Patent
Sato et al.

(10) Patent No.: US 10,744,758 B2
(45) Date of Patent: Aug. 18, 2020

(54) LIQUID DISCHARGE APPARATUS

(71) Applicant: BROTHER KOGYO KABUSHIKI KAISHA, Nagoya-shi, Aichi-ken (JP)

(72) Inventors: Shoji Sato, Okazaki (JP); Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/426,027

(22) Filed: May 30, 2019

(65) Prior Publication Data

US 2019/0366710 A1 Dec. 5, 2019

(30) Foreign Application Priority Data

May 31, 2018 (JP) ..... 2018-104559

(51) Int. Cl.

| | |
|---|---|
| ***B41J 2/045*** | (2006.01) |
| ***B41J 2/14*** | (2006.01) |
| ***B41J 19/20*** | (2006.01) |
| ***B41J 11/00*** | (2006.01) |
| ***B41J 25/308*** | (2006.01) |

(52) U.S. Cl.

CPC ..... *B41J 2/04556* (2013.01); *B41J 2/14153* (2013.01); *B41J 11/0095* (2013.01); *B41J 19/205* (2013.01); *B41J 25/308* (2013.01)

(58) Field of Classification Search

CPC .. B41J 2/04556; B41J 25/308; B41J 11/0095; B41J 19/205

See application file for complete search history.

(56) References Cited

U.S. PATENT DOCUMENTS 5,476,328 A * 12/1995 Hori ..... B41J 25/308 400/56
5,541,626 A * 7/1996 Hiramatsu ..... B41J 3/4078 347/8
5,988,784 A * 11/1999 Takemura ..... B41J 2/04503 347/14

FOREIGN PATENT DOCUMENTS

JP 2010-173150 A 8/2010
JP 2010-184443 A 8/2010

* cited by examiner

*Primary Examiner* — Julian D Huffman

(74) *Attorney, Agent, or Firm* — Scully, Scott, Murphy & Presser, PC

(57) ABSTRACT

There is provided a liquid discharge apparatus including: a liquid discharge head having a nozzle surface; a carriage; a carriage mover; a conveyor conveying a medium in a conveyance direction; a velocity sensor; a distance sensor; and a controller. The controller makes a determination regarding the velocity of the carriage based on output of the velocity sensor, and makes a determination regarding the distance between the medium and the nozzle surface based on output of the distance sensor. In a case that that the controller determines that the velocity is less than a predetermined velocity and that the distance is less than a predetermined distance, the controller interrupts recording performed by the liquid discharge head.

12 Claims, 8 Drawing Sheets

LIQUID DISCHARGE APPARATUS

CROSS REFERENCE TO RELATED APPLICATION

The present application claims priority from Japanese Patent Application No. 2018-104559, filed on May 31, 2018, the disclosure of which is incorporated herein by reference in their entirety.

BACKGROUND

Field of the Invention

The present disclosure relates to a liquid discharge apparatus discharging a liquid from a nozzle toward a medium.

Description of the Related Art

Conventionally, it is known that occurrence of paper rubbing (contact made by a medium such as paper sheet with respect to a nozzle surface) decreases the velocity of a carriage, which in turn increases the value of electric current applied to a motor. Further, conventionally it is known that, under a condition that the value of electric current exceeds a threshold value, it is determined that the medium makes a contact with the nozzle surface, and that recording of an image on the medium is interrupted or paused.

Furthermore, it is known that, in order to avoid any paper rubbing (contact made by a medium such as paper sheet with respect to a nozzle surface), the distance between the medium and the nozzle surface is detected, and in a case that determination is made, based on the detected distance, that the medium might make contact with the nozzle surface, the distance is adjusted.

SUMMARY

The decrease in the velocity of carriage occurs not only by the case wherein the medium makes contact with the nozzle surface, but also in a case that any foreign matter (sand, dust, etc.) enters into the inside of a carriage mover which moves the carriage. Therefore, according to the publicly known technique as described above, even in a case that the medium does not make contact with the nozzle surface, such a determination might be made that the velocity of the carriage is lowered, and thus the recording might be interrupted.

Further, there is such a medium of which end portion is originally curled. Furthermore, there is also such a case that the medium is deformed during the recording. For example, there is known the cockling phenomenon that is a phenomenon in which the medium absorbs a solvent in the liquid and thus is waved. In the above-described publicly known technique, in a case that the distance between the nozzle surface and a curled end portion or deformed portion of the medium is detected, such a determination might be made that the medium is likely to contact with the nozzle surface, despite that the medium is less likely to make contact with the nozzle surface, and the distance might be adjusted (namely, the recording might be interrupted).

An object of the present disclosure is to provide a liquid discharge apparatus capable of determining, with high precision, the absence or presence of contact made by the medium with respect to the nozzle surface, and of suppressing such a problem that the recording is unnecessarily interrupted.

According to an aspect of the present disclosure, there is provided a liquid discharge apparatus configured to discharge a liquid onto a medium, the liquid discharge apparatus including: a liquid discharge head having a nozzle surface in which a nozzle is opened; a carriage having the liquid discharge head mounted thereon; a carriage mover configured to move the carriage in a moving direction parallel to the nozzle surface; a conveyor configured to convey the medium in a conveyance direction which is parallel to the nozzle surface and which crosses the moving direction; a velocity sensor configured to output a velocity signal in accordance with velocity of the carriage; a distance sensor configured to output a distance signal in accordance with distance between the medium and the nozzle surface in a direction perpendicular to the nozzle surface; and a controller. The controller is configured to: perform recording of an image on the medium by alternately controlling the conveyor to perform conveyance of the medium in the conveyance direction, and controlling the liquid discharge head to perform discharging of the liquid from the nozzle while controlling the carriage mover to move the carriage in the moving direction; make a determination regarding the velocity based on the velocity signal; make a determination regarding the distance based on the distance signal; and control the liquid discharge head to interrupt the recording, in a case that the controller determines that the velocity is less than a predetermined velocity and that the distance is less than a predetermined distance.

According to the present disclosure, the controller makes a determination regarding the presence or absence of the contact made by the medium with respect to the nozzle surface, based not on only the velocity or the distance, but based on both of the velocity and the distance. With this, it is possible to make, with high precision, a determination regarding the absence or presence of contact made by the medium with respect to the nozzle surface, and to suppress such a problem that the recording is unnecessarily interrupted.

DESCRIPTION OF THE EMBODIMENT

Figure 1:
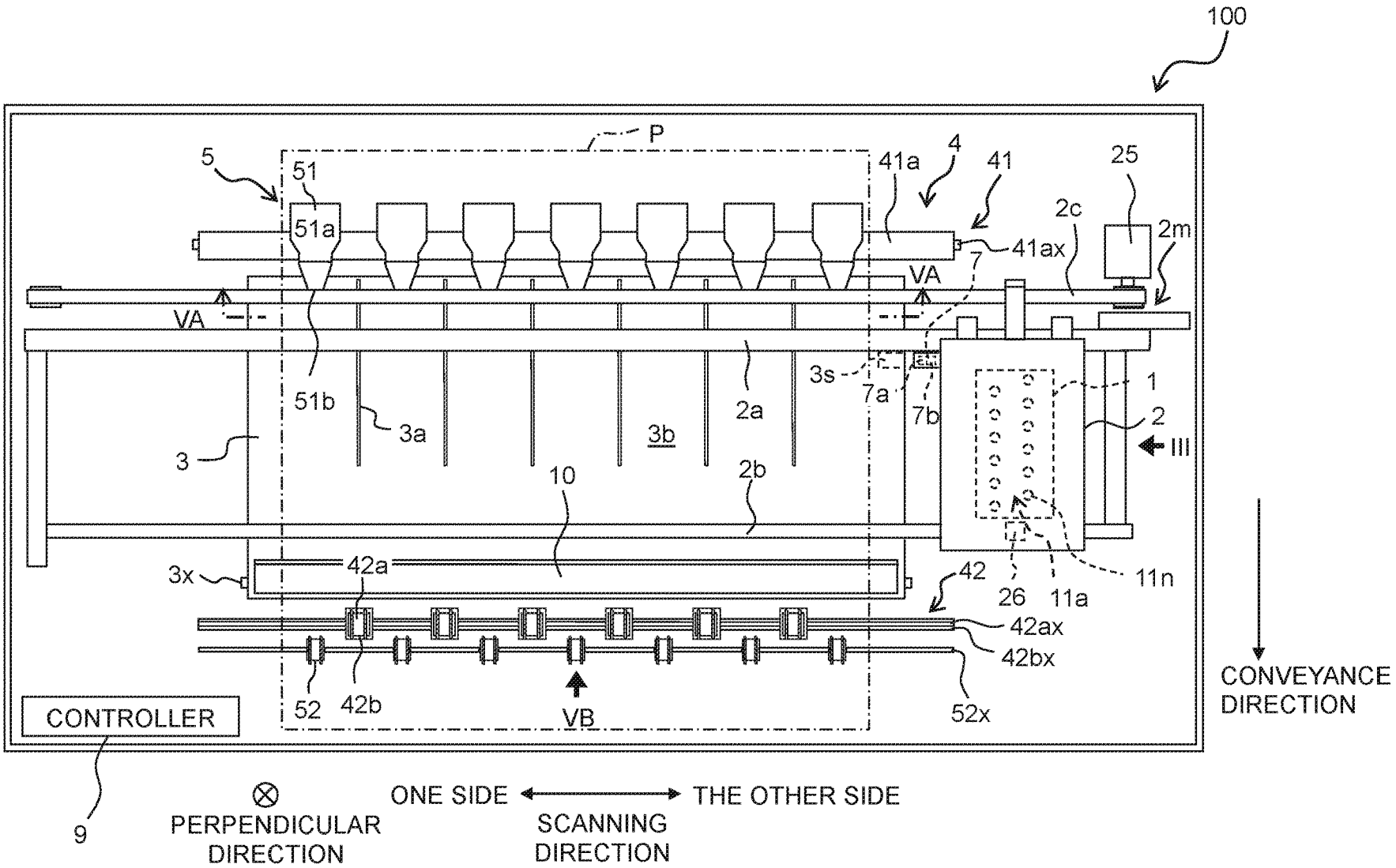
FIG. 1 is a plan view of a printer 100.

A printer 100 according to an embodiment of the present disclosure is provided with a head 1, a carriage 2, a platen 3, a conveyor 4, a waved shape-imparting mechanism 5, an optical sensor 7 and a controller 9, as depicted in FIG. 1.

Figure 2:
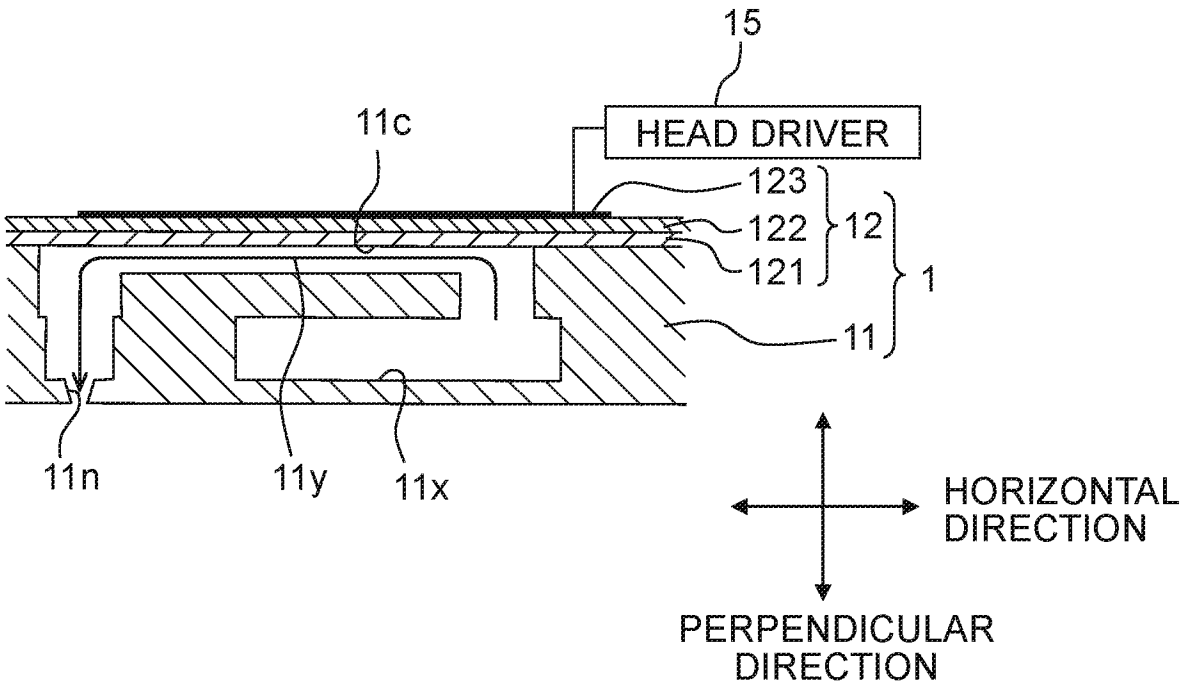
FIG. 2 is a cross-sectional view of a portion of a head included in the printer depicted in FIG. 1.

The head 1 includes a channel unit 11 and an actuator unit 12, as depicted in FIG. 2. The lower surface of the channel unit 11 is a nozzle surface 11*a* in which a plurality of nozzles 11*n* are opened. The channel unit 11 has a common channel

11*x* communicating with a non-illustrated ink tank and a plurality of individual channels 11*y* arriving, from the common channel 11*x*, at the plurality of nozzles 11*a*, respectively; the common channel 11*x* and the plurality of individual channels 11*y* are formed in the inside of the channel unit 11. A plurality of pressure chambers 11*c* included in the plurality of individual channels 11*y*, respectively, are open in the upper surface of the channel unit 11. The actuator unit 12 includes a vibration plate 121 arranged on the upper surface of the channel unit 11 to cover the plurality of pressure chambers 11*c*, a piezoelectric layer 122 arranged on the upper surface of the vibration plate 121, and a plurality of individual electrodes 123 arranged on the upper surface of the piezoelectric layer 122 to face the plurality of pressure chambers 11*c*, respectively. Portions of the vibration plate 121 and the piezoelectric layer 122, respectively, each of which is sandwiched between one of the individual electrodes 123 and one of the pressure chambers 11*c* function as an individual unimorph-typed actuator for one of the pressure chambers 11*c*; and the sandwiched portions are deformable in accordance with application of voltage by a head driver 15 for each of the individual electrodes 123. By deformation of the actuator to project toward a certain pressure chamber 11*c*, included in the plurality of pressure chambers 11*c*, decreases the volume of the certain pressure chamber 11*c*, thereby applying pressure to the ink inside the certain pressure chamber 11*c* and discharging the ink from a certain nozzle 11*n* included in the plurality of nozzles 11*n* and communicating with the certain pressure chamber 11*c*.

As depicted in FIG. 1, the carriage 2 is configured to mount the head 1 thereon and to be movable in a scanning direction parallel to the nozzle surface 11*a*. Specifically, in a case of performing recording of an image on a paper sheet P, the carriage 2 performs a reciprocating movement composed of a forward motion from one side (right side in FIG. 1) toward the other side (left side in FIG. 1) in the scanning direction, with a home position indicated in FIG. 1 as the starting point, and a backward (returning) motion from the other side toward the one side in the scanning direction and returning to the home position. The home position is located at the one side in the scanning direction relative to the platen 3, and is a position at which the nozzle surface 11*a* does not overlap with the platen 3 in a perpendicular direction (orthogonal direction orthogonal to the nozzle surface 11*a*).

The carriage 2 is supported by two guide rails 2*a* and 2*b* at a location above the platen 3, and is connected to an endless belt 2*c*. The endless belt 2*c* is connected to a driving gear of a carriage motor 25. The controller 9 controls the carriage motor 25 to drive the carriage motor 25, which in turn rotate the driving gear, thereby allowing the endless belt 2*c* to run to move the carriage 2 in the scanning direction along the guide rails 2*a* and 2*b*. In the present embodiment, the guide rails 2*a* and 2*b* and the endless belt 2*c* construct a carriage mover 2*m*. The scanning direction corresponds to a "moving direction".

The carriage 2 is provided with a linear encoder 26. The linear encoder 26 has a light-emitting element and a light-receiving element. The light-emitting element and the light-receiving element of the linear encoder 26 are arranged to sandwich a scale (not depicted in the drawings), which is arranged on the guide rail 2*b*, between the light-emitting and receiving elements. The scale extends in the scanning direction and has transmissible areas and non-transmissible areas which are formed alternately in the scanning direction at a predetermined spacing distance therebetween. In a case that the linear encoder 26 faces a transmissive area included in the transmissive areas, a light irradiated from the light-emitting element passes through the transmissive area and is received by the light-receiving element. In a case that the linear encoder 26 faces a non-transmissive area included in the non-transmissive areas, the light irradiated from the light-emitting element is shut off by the non-transmissive area and is not received by the light-receiving element. Accordingly, in a case that the carriage 2 is being moved in the scanning direction, the light-receiving element alternates between a state that the light-receiving elements receives the light from the light-emitting element and a state that the light-receiving element does not receive the light from the light-emitting element.

As depicted in FIG. 1, the conveyor 4 includes a pair of upstream rollers 41 arranged upstream in a conveyance direction relative to the head 1 and a pair of downstream rollers 42 arranged downstream in the conveyance direction relative to the head 1. The conveyance direction is parallel to the nozzle surface 11*a* and is orthogonal to the scanning direction.

Figure 3:
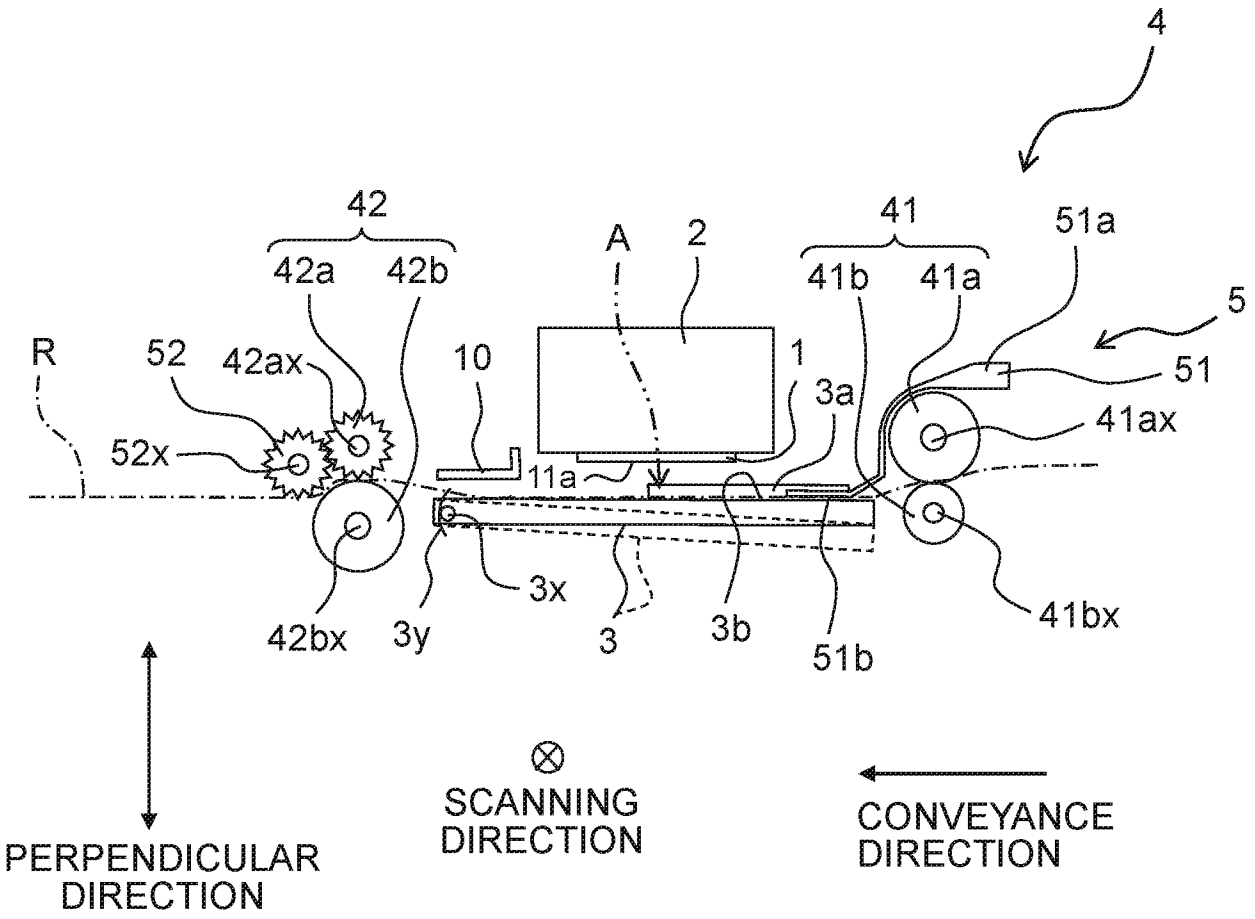
FIG. 3 is a side view of FIG. 1 as seen from a direction of an arrow III in FIG. 1.

The pair of upstream rollers 41 includes an upper roller 41*a* and a lower roller 41*b*, as depicted in FIG. 3. The upper roller 41*a* and the lower roller 41*b* are each elongated in the scanning direction and are arranged in an up/down direction such that the circumferential surfaces thereof make contact with each other. The upper roller 41*a* and the lower roller 41*b* are supported by shafts 41*ax* and 41*bx*, which extend in the scanning direction, respectively, and are rotatable about the shafts 41*ax* and 41*bx*, with the shafts 41*ax* and 41*bx* as the centers or rotation, respectively.

The pair of downstream rollers 42 includes six upper rollers 42*a* and six lower rollers 42*b*, as depicted in FIG. 1. Each of the upper rollers 42*a* forms a pair with one of the lower rollers 42*b*, and the upper and lower rollers 42*a* and 42*b* are arranged in the up/down direction such that the circumferential surfaces thereof make contact with each other. Namely, the pair of downstream rollers 42 has six pairs each of which is composed of one upper roller 42*a* and one lower roller 42*b*. The six pairs are arranged side by side in the scanning direction at regular spacing distances therebetween. The six upper rollers 42*a* are supported by a shaft 42*ax*, which extends in the scanning direction, and are rotatable about the shaft 42*ax*, with the shaft 42*ax* as the center of rotation. The six lower rollers 42*b* are supported by a shaft 42*bx*, which extends in the scanning direction, and are rotatable about the shaft 42*bx*, with the shaft 42*bx* as the center of rotation.

The controller 9 controls a conveyance motor 45 (see FIG. 6) to drive the conveyance motor 45, which in turn drives one of the upper roller and the lower roller of each of the pairs of upper and lower rollers 41 and 42 to be rotated, and the other of the upper roller and the lower roller of each of the pairs of upper and lower rollers 41 and 42 follows the rotations. Further, the upper roller and lower roller of at least one of the pairs of upper and lower rollers 41 and 42 rotate while holding the paper sheet P therebetween, to thereby convey the paper sheet P in the conveyance direction along a conveyance route R as depicted in FIG. 3. The conveyance route R extends from a paper feed tray (not depicted in the drawings) up to a paper discharge tray (not depicted in the drawings) via a facing position A, on a surface (surface facing the nozzle surface 11*a*) of the platen 3, at which the platen 3 faces the nozzle surface 11*a*.

Note that the upper roller 41*a* and the lower roller 41*b* of the pair of upstream rollers 41 and the lower rollers 42*b* of the pair of downstream rollers 42 are each a rubber roller in which any projection is not formed in the outer circumferential surface thereof, whereas the upper rollers 42*a* of the pair of downstream rollers 42 are each a spur roller having a plurality of projections formed in the outer circumferential surface thereof. With this, an ink landed on the surface of the paper sheet p is less likely to adhere to the upper rollers 42*a*.

A member 10 configured to guide the paper sheet P from the facing position A toward the pair of downstream rollers 42 is provided between the pair of downstream rollers 42 and the nozzle surface 11*a*. The member 10 is arranged in the vicinity of the nozzle surface 11*a*. More specifically, the member 10 is arranged, in the conveyance direction, between the guide rail 2*b* and the pair of downstream rollers 42, as depicted in FIG. 1.

As depicted in FIG. 3, the platen 3 is arranged at a location below the head 1 and the carriage 2, and supports the paper sheet P at the facing position A on the surface of the platen 3. Namely, the platen 3 corresponds to a "supporting member". The surface of the platen 3 has a base part 3*b*, and six ribs 3*a* projecting from the base part 3*a*. The six ribs 3*b* construct the waved-shape imparting mechanism 5. In the present embodiment, the paper sheet P is supported by end portions of the six ribs 3*a*.

The platen 3 is configured to be rotatable about a shaft 3*x*, with the shaft 3*x* as the center of rotation. The shaft 3*x* extends in the scanning direction at a downstream end portion in the conveyance direction of the platen 3. The platen 3 is movable between an upper limit position indicated by solid lines in FIG. 3 and a lower limit position indicated by broken lines in FIG. 3. The upper limit position is a position at which the surface of the platen 3 is parallel to the nozzle surface 11*a*. Among positions assumable by the platen 3, the surface of the platen 3 is inclined with respect to the nozzle surface 11*a* at a position different from the upper limit position. As the platen 3 is moved from the upper limit position toward the lower limit position, a spacing distance in the perpendicular direction between an upstream end portion in the conveyance direction of the platen 3 and the nozzle surface 11*a* becomes greater.

In a case that any external force does not act on the platen 3, or in a case that a normal paper sheet P is appropriately supported by the platen 3, the platen 3 is located at the upper limit position. The external force acting on the platen 3 is exemplified, for example, by the self-weight of the paper sheet P. The term "normal paper sheet P" means, for example, paper sheet which is relatively light-weight and different from a paper sheet having a large weight, such as a thick paper sheet, etc. The phrase that the "normal paper sheet P is appropriately supported by the platen 3" indicates such a situation that the self-weight of the normal paper sheet P acts on the platen 3. On the other hand, in a case that the paper sheet having a large weight, such as the thick paper sheet, etc. is appropriately supported by the platen 3, namely, in a case that the self-weight of such a thick paper sheet P acts on the platen 3, the platen 3 is located at an intermediate position between the upper limit position and the lower limit position. Note that in the case that the paper sheet P is appropriately supported by the platen 3, not only that the self-weight of the paper sheet P acts on the platen 3, but also a force applied to the paper sheet P by the conveyor 4 and the force applied to the paper sheet P by the waved-shape applying mechanism 5 act on the platen 3. These forces are collectively referred to as the self-weight, etc., of the paper sheet P. The self-weight, etc., of the paper sheet P acts on the upstream end portion in the conveyance direction of the platen 3 by being pressed by a corrugate plate 51.

Since the self-weight of the paper sheet P is generally proportional to the thickness of the paper sheet P, it is possible to make the gap between the nozzle surface 11*a* and the surface of the paper sheet P supported by the platen 3 to be constant, due to the above-described change in the position of the platen 3, regardless of the thickness of the paper sheet P. Namely, as the thickness of the paper sheet P is greater, the position of the platen 3 approaches more closely toward the lower limit position.

In the present embodiment, the upper limit position corresponds to a "first supporting position" with respect to the normal paper sheet P, the intermediate position corresponds to a "first supporting position" with respect to the paper sheet P having a relatively large weight, and the lower limit position corresponds to a "second supporting position".

A coil spring 3*y* is wound around the shaft 3*x*. The coil spring 3*y* urges the platen 3 in a counterclockwise direction in FIG. 3 (namely, in a direction toward the first supporting position from the second supporting position).

Figure 4:
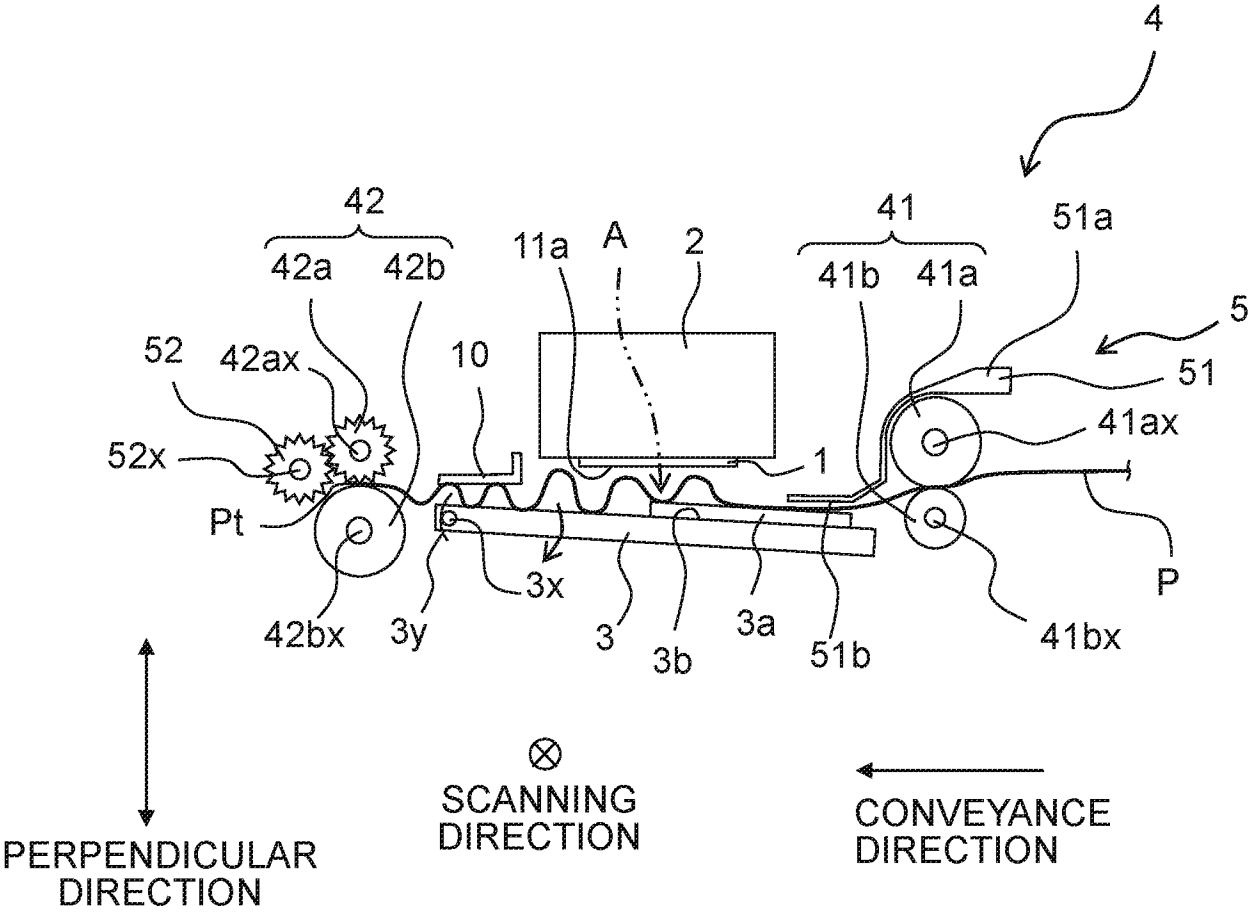
FIG. 4 is a side view corresponding to FIG. 3 and depicting an example of jamming of paper sheet P.

For example, in a case that jamming of the paper sheet P as depicted in FIG. 4 occurs, the platen 3 is moved from the first supporting position to the second supporting position, against the urging force of the coil spring 3*y*. FIG. 4 depicts a case wherein the conveyance of the paper sheet P is continued in a state that a forward end portion Pt in the conveyance direction of the paper sheet P is not appropriately held by the pair of downstream rollers 42, and the jamming occurs. Since the member 10 is located in the vicinity of the nozzle surface 11*a*, a portion, of the paper sheet P, which is deformed due to the jamming easily makes contact with the member 10. In a case that the conveyance of the paper sheet P is continued in a state that the paper sheet P makes contact with the member 10, the paper sheet P is warped downward to thereby push or press the platen 3, which in turn causes the platen 3 to move from the first supporting position to the second supporting position.

As depicted in FIG. 1, the waved-shape applying mechanism 5 includes seven pieces of the corrugate plate 51, the six ribs 3*a* formed on the surface of the platen 3, seven corrugate spurs 52, and the six pairs each of which is composed of one upper roller 42*a* and one lower roller 42*b* in the pair of downstream rollers 42.

The seven corrugate plates 51 are arranged side by side in the scanning direction at regular spacing distances therebetween, at the upstream in the conveyance direction relative to the head 1. As depicted in FIG. 3, each of the corrugate plates 51 includes a base part 51*a* arranged at a location above the upper roller 41*a* of the pair of upstream rollers 41, and a pressing part 51*b* extending from the base part 51*a* toward the downstream side in the conveyance direction and facing a surface of the upstream end portion in the conveyance direction of the platen 3. The pressing part 51*b* faces the surface of the platen 3 located at the first supporting position, with a gap to some extent between the pressing part 51*b* and the surface of the platen 3.

As depicted in FIG. 1, the six ribs 3*a* are arranged side by side in the scanning direction at regular spacing distances therebetween, and each of the six ribs 3 is arranged between adjacent corrugate plates 51 which are included in the seven corrugate plates 51 and which are adjacent in the scanning direction. Each of the ribs 3*a* extends in the conveyance direction. The six ribs 3*a* are located at positions in the scanning direction which are coincident, respectively, with those of the six pairs each of which is composed of one upper roller 42*a* and one lower roller 42*b* in the pair of downstream rollers 42.

Figure 5A:
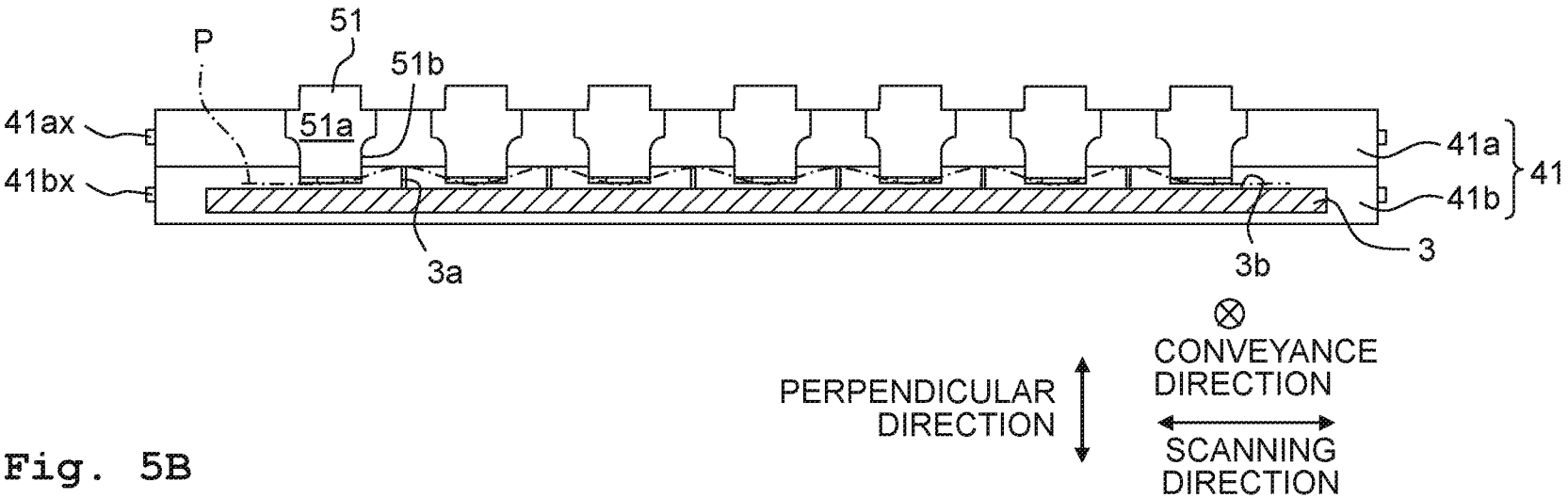
FIG. 5A is a cross-sectional view taken along a line VA-VA in FIG. 1.

As depicted in FIG. 5A, an upper end portion of each of the ribs 3*a* is positioned to be above the pressing part 51*b* of one of the corrugate plates 51. In such a positional relationship, the upper end portions of the six ribs 3*a* support the paper sheet P from therebelow, and the pressing parts 51*b* of the seven corrugate plates 51 press the paper sheet P from thereabove, thereby imparting a waved shape along the scanning direction to the paper sheet P.

As depicted in FIG. 1, the seven corrugate spurs 52 are arranged at downstream in the conveyance direction relative to the pair of downstream rollers 42, and the seven corrugate spurs 52 are arranged side by side at regular spacing distances therebetween in the scanning direction. The seven corrugate spurs 52 are located at positions in the scanning direction which are coincident, respectively, with those of the seven corrugate plates 51. The six pairs each of which is composed of one upper roller 42*a* and one lower roller 42*b* in the pair of downstream rollers 42 are each arranged between adjacent corrugate spurs 52 which are included in the seven corrugate spurs 52 and which are adjacent in the scanning direction. The seven corrugate spurs 52 are supported by a shaft 52*x*, which extends in the scanning direction, and are rotatable about the shaft 52*x*, with the shaft 52*x* as the center of rotation.

Figure 5B:
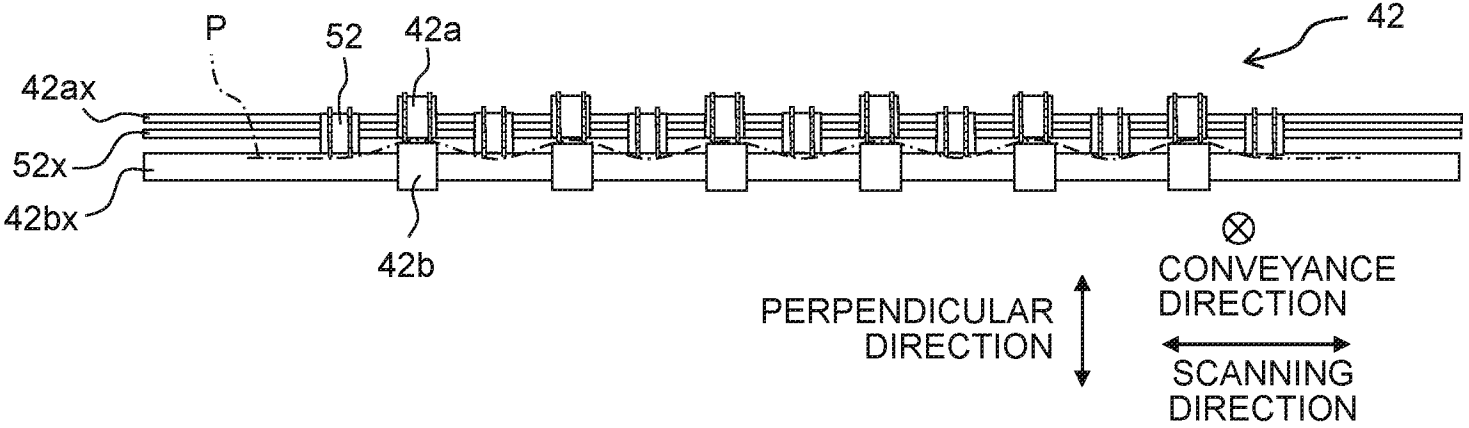
FIG. 5B is a side view as seen from a direction of an arrow VB in FIG. 1.

The contact points at which the upper rollers 42*a* make contact with the lower rollers 42*b*, respectively, are located to be above lower end portions of the corrugate spurs 52, respectively, as depicted in FIG. 5B. In such a positional relationship, the six lower rollers 42*b* support the paper sheet P from therebelow, and the seven corrugate spur 52 presses the paper sheet P from thereabove, thereby imparting a waved shape along the scanning direction to the paper sheet P.

The waved shape along the scanning direction is imparted to the paper sheet P by the waved-shape imparting mechanism 5, thereby imparting strength to the paper sheet P and realizing satisfactory conveyance of the paper sheet P.

As depicted in FIG. 1, the optical sensor 7 is provided on the carriage 2, at an end portion thereof which is located on the other side in the scanning direction (the left side in FIG. 1), the end portion being upstream in the conveyance direction relative to the head 1. The optical sensor 7 is a reflective-type optical sensor and has a light-emitting element 7*a* and a light-receiving element 7*b*.

The light-emitting element 7*a* emits a light downwardly (in a direction toward the surface of the platen 3 from the nozzle surface 11*a*), toward the surface of the paper sheet P or a detection-target part 3*s* of the platen 3. Namely, there is a case wherein the light-emitting element 7*a* emits the light toward the surface of the paper sheet P in a case that the light-emitting element 7*a* faces, in the perpendicular direction, the paper sheet P supported by the platen 3; and there is a case wherein the light-emitting element 7*a* emits the light toward the detection-target part 3*s* of the platen 3 in a case that the light-emitting element 7*a* faces, in the perpendicular direction, the detection-target part 3*s* of the platen 3.

The light-receiving element 7*b* is located at a position which is above relative to the surface of the platen 3 (direction toward the nozzle surface 11*a* from the surface of the platen 3). The light-receiving element 7*b* receives a light reflected by the surface of the paper sheet P or reflected by the detection-target part 3*s* of the platen 3, and outputs an output signal based on the light. The output signal output by the light-receiving element 7*b* changes depending on the distance between the nozzle surface 11*a* and the surface of the paper sheet P or the detection-target part 3*s* of the platen 3. Namely, the output of the light-receiving element 7*b* changes based on the distance between the paper sheet P and the nozzle surface 11*a*, and the optical sensor 7 corresponds to a "distance sensor". Further, since the distance between the nozzle surface 11*a* and the detection-target part 3*s* of the platen 3 changes depending on the position of the platen 3, the output of the light-receiving element 7*b* changes based on the position of the platen 3, and the optical sensor 7 also corresponds to a "position sensor".

The detection-target part 3*s* is provided on the platen 3, at an end part thereof on the one side in the scanning direction, and is arranged at upstream in the conveyance direction relative to the shaft 3*x*. The detection-target part 3*s* is a part or portion, in the surface of the platen 3, which is not covered by the paper sheet P in a case that the platen 3 supports the paper sheet P, and the detection-target part 3*s* is constructed of a plane (the base part 3*b*) which is parallel to the nozzle surface 11*a* in a case that the platen 3 is located at the first supporting position. More specifically, the controller 9 is capable of performing "marginless recording (borderless recording)"; the detection-target part 3*s* is arranged at the outside, in a width direction (direction orthogonal to the conveyance direction), of an area in which a paper sheet P of which length in the width direction is the greatest among a plurality of paper sheets P supportable by the platen 3 covers the platen 3, and also at the outside, in the width direction, of a recording area for the marginless recording with respect to the paper sheet P of which length in the width direction is the greatest. Note that the term "marginless recording" means recording an image by discharging or jetting an ink from the nozzles 11*n* onto an area including edge portions in the width direction in the paper sheet P.

Figure 6:
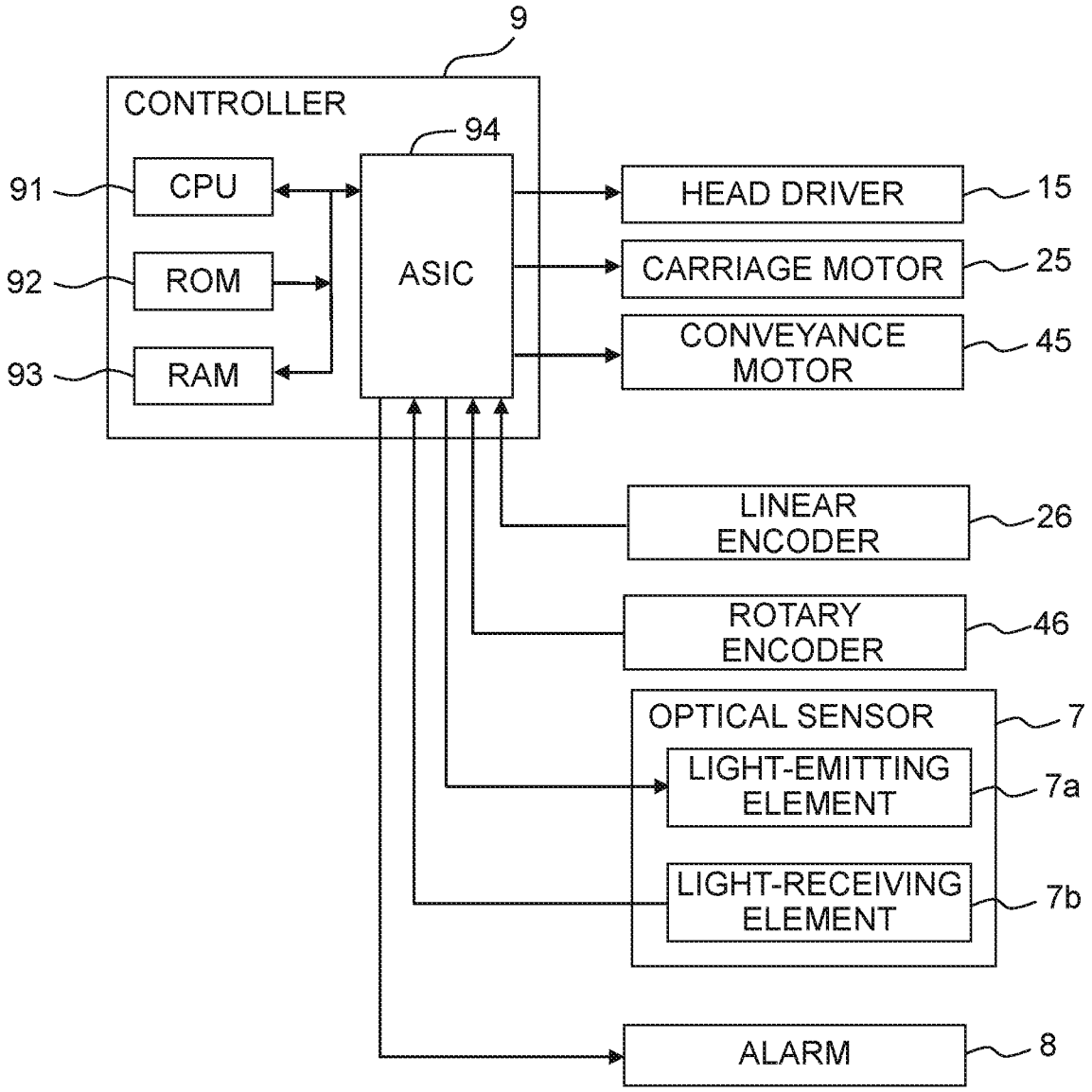
FIG. 6 is a block diagram depicting the electrical configuration of the printer depicted in FIG. 1.

As depicted in FIG. 6, the controller 9 has a CPU (Central Processing Unit) 91, a ROM (Read Only Memory) 92, a RAM (Random Access Memory) 93 and an ASIC (Application Specific Integrated Circuit) 94 including a variety of kinds of control circuits. The controller 9 is connected to an external apparatus such as a PC (Personal Computer), etc., such that data can be transmitted between the controller 9 and the external apparatus.

The ROM 92 stores a program, data, etc., with which the CPU 91 controls a variety of kinds of operations. The RAM 93 temporarily stores data which is used when the CPU 91 executes the program. The CPU 91 issues an instruction or command to the ASIC 94 based on a recording command inputted thereto from the external apparatus, and in accordance with the program, data, etc., stored in the ROM 92 and/or the RAM 93. The controller 9 including the CPU 91 and the ASIC 94 corresponds to a "controller" of the present disclosure.

The head driver 15, the carriage motor 25 and the conveyance motor 45 are connected to the ASIC 94. According to a command from the CPU 91, the ASIC 94 controls the head driver 15, the carriage motor 25 and the conveyance motor 45 to thereby cause the head driver 15, the carriage motor 25 and the conveyance motor 45 to alternately perform a "conveying operation" of conveying the paper sheet P in the conveyance direction with the conveyor 4, and a "discharging operation" of discharging the ink from the nozzles 11*n* while moving the carriage 2 in the scanning direction with the carriage mover 2*m*. Namely, during the recording, the paper sheet P is conveyed intermittently. The "discharging operation" is performed at a period which is between a certain (one time of) conveying operation and another conveying operation to be performed next to the certain conveying operation and during which the conveyance of the paper sheet P is paused or stopped. By performing the "conveying operation" and the "discharging operation" alternately, dots of an ink are formed on a surface of the paper sheet P and thus an image is recorded on the surface of the paper sheet P. The image includes a combination of a drawing and a letter, only a drawing, and only a letter.

Note that a conveyance amount by which the paper sheet P is conveyed in one time of the conveying operation changes depending on data of an image (image data); there is also such a case that conveying operations performed a plurality of times have conveyance amounts, respectively, which are not constant or same from each other. Further, there are also such cases that, depending on a designated image quality and/or recording velocity, etc.: (i) the carriage 2 performs the forward movement or backward movement in one time of the discharging operation, (ii) the carriage 2 performs the forward and backward movements in one time of the discharging operation, and (iii) the carriage 2 performs not less than two times of the forward and backward movements in one time of the discharging operation.

Further, the linear encoder 26 and a rotary encoder 46 configured to output a signal indicating the number of rotations of the conveyance motor 45 are connected to the ASIC 94. The ASIC 94 receives signals output from the linear encoder 26 and the rotary encoder 46, respectively, and transfers the signals to the CPU 91. The CPU 91 makes a determination regarding the velocity of the carriage 2 based on the signal output from the linear encoder 26. Namely, the output from the linear encoder 26 changes depending on the velocity of the carriage 2, and the linear encoder 26 corresponds to a "velocity sensor". Further, the CPU 91 makes a determination regarding the position of the paper sheet P in the conveyance route R, based on the signal output from the rotary encoder 46.

Furthermore, the optical sensor 7 is connected to the ASIC 94. Based on a command from the CPU 91, the ASIC 94 inputs an input signal to the light-emitting element 7*a* to thereby cause the light-emitting element to emit a light. Moreover, the ASIC 94 receives an output signal output from the light-receiving element 7*b* and transfers this output signal to the CPU 91. The CPU 91 makes a determination regarding the distance between the paper sheet P and the nozzle surface 11*a* based on the output signal from the light-receiving element 7*b*. Further, the CPU 91 makes a determination regarding the position of the platen 3, based on the output signal from the light-receiving element 7*b*.

Furthermore, an alarm 8 (for example, a speaker, a display, etc.,) which is configured to perform notification to a user is connected to the ASIC 94. The ASIC 94 transmits a notification signal to the alarm 8, in accordance with a command from the CPU 91, to thereby cause the alarm 8 to perform notification to the user (for example, an audio output with the speaker, a screen display by the display, etc.).

Figure 7A:
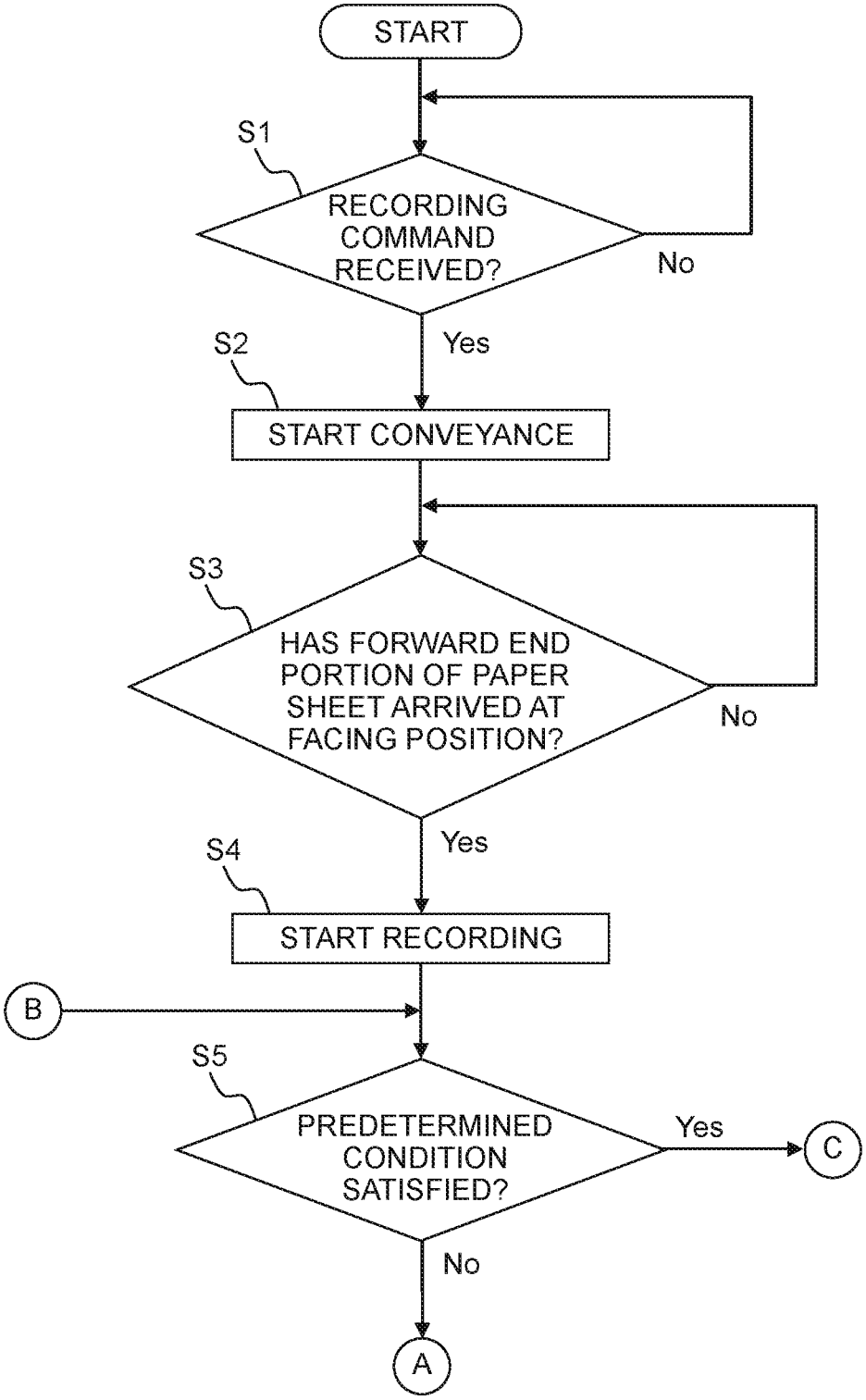
FIGS. 7A and 7B show a flow chart depicting the content of control in recording performed in the printer depicted in FIG. 1.
Figure 7B:
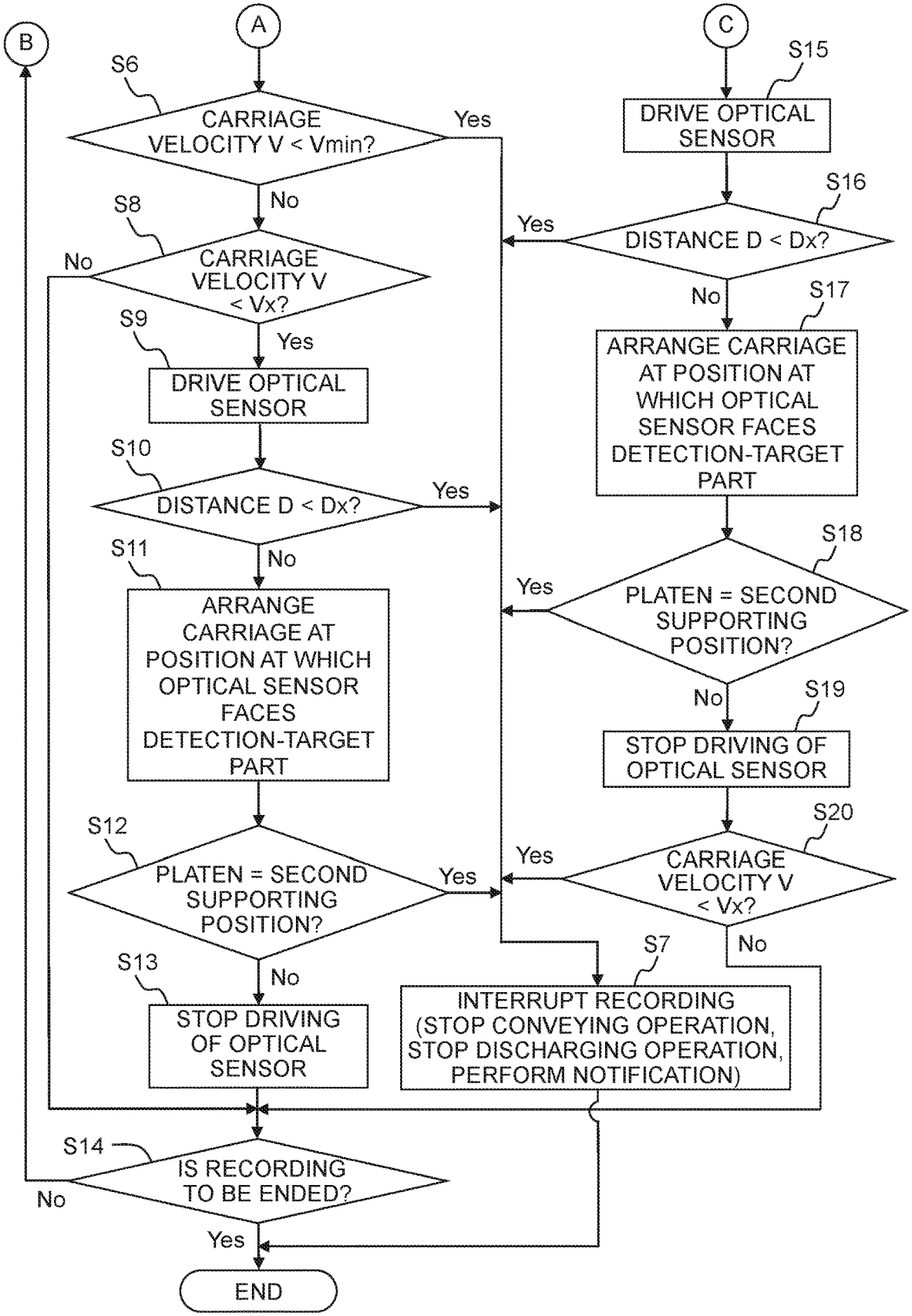

Next, the content of control regarding recording will be explained, with reference to FIGS. 7A and 7B.

Firstly, the CPU 91 determines whether or not the CPU 91 has received the recording command from the external apparatus (51). In a case that the CPU 91 has not received the recording command (51: NO), the processing of step 51 is repeated. In a case that the CPU 91 has received the recording command (51: YES), the CPU 91 controls the conveyance motor 45 via the ASIC 94 to start the conveyance of the paper sheet P (S2).

After the processing of step S2, the CPU 91 determines whether or not a forward end portion of the paper sheet P has reached the facing position A, based on the signal of the rotary encoder 46 which is transferred from the ASIC 94 (S3). In a case that the forward end portion of the paper sheet P has not reached the facing position A (S3: NO), the processing of step S3 is repeated.

In a case that the forward end portion of the paper sheet P has reached the facing position A (S3: YES), the CPU 91 controls the respective parts or portions of the printer 100 to start the recording (S4). Specifically, the CPU 91 controls the head driver 15, the carriage motor 25 and the conveyance motor 45 via the ASIC 94 to thereby cause the head driver 15, the carriage motor 25 and the conveyance motor 45 to alternately perform the "conveying operation" of conveying the paper sheet P in the conveyance direction with the conveyor 4, and the "discharging operation" of discharging the ink from the nozzles 11*n* while moving the carriage 2 in the scanning direction with the carriage mover 2*m*.

After the processing of step S4, the CPU 91 determines whether or not a predetermined condition is satisfied (S5). The predetermined condition is such a condition that even if the paper sheet P makes contact with the nozzle surface 11*a*, any lowering in the velocity of the carriage 2 is less likely to occur, and includes, for example, a condition that the conveyance amount in one time of the conveying operation is less than a threshold value (a high image quality or high definition setting), a condition that the rigidity of the paper sheet P is less than a threshold value, a condition that the thickness of the paper sheet P is less than a threshold value, a condition that a water content or moisture content of the paper sheet P is not less than a threshold value, a condition that the environmental temperature is not less than a threshold value, a condition that the environmental moisture is not less than a threshold value, and any other condition or conditions allowing any foreign matter such as sand and dust to easily enter into the carriage mover 2*m*, etc. It is allowable that the CPU 91 makes the determination of the processing in step S5 based on a variety of kinds of data included in the recording command, a signal from a temperature sensor and/or a humidity sensor, etc.

In a case that the predetermined condition (namely, the condition not allowing the lowering in the velocity of the carriage 2 to easily occur, even if the paper sheet P makes contact with the nozzle surface 11*a*) is not satisfied (S5: NO), the CPU 91 makes a determination regarding a velocity V of the carriage 2, based on the signal of the linear encoder 26 transferred from the ASIC 94, and determines whether or not the velocity V is less than a lower limit value Vmin (S6).

In a case that the velocity V is less than the lower limit value Vmin (S6: YES), the CPU 91 interrupts the recording (S7). Specifically, the CPU 91 controls the conveyance motor 45 via the ASIC 94 to thereby perform a processing of stopping the conveying operation; the CPU 91 controls the carriage motor 25 via the ASIC 94 to thereby perform a processing of stopping the discharging operation; and the CPU 91 controls the alarm 8 via the ASIC 94 to thereby perform a processing of causing the alarm 8 to perform notification to the user. Further, in a case that the optical sensor 7 is driven, the CPU 91 performs, via the ASIC 94, a processing of stopping the driving of the optical sensor 7. After the processing of step S7, the CPU 91 ends this routine.

In a case that the velocity V is not less than the lower limit value Vmin (S6: NO), the CPU 91 determines whether or not the velocity V is less than a predetermined velocity Vx (S8). The predetermined velocity Vx has a value greater than that of the lower limit value Vmin In a case that the velocity V is not less than the predetermined velocity Vx (S8: NO), the CPU 91 proceeds to the processing of step S14.

In a case that the velocity V is less than the predetermined velocity Vx (S8: YES), the CPU 91 drives the optical sensor 7 via the ASIC 94 (S9). Specifically, the CPU 91 inputs, via the ASIC 94, an input signal to the light-emitting element 7*a* to cause the light-emitting element 7*a* to start the light emission. In this situation, the light-emitting element 7*a* faces, in the perpendicular direction, the paper sheet P which is supported by the platen 3 and irradiates a light toward the surface of the paper sheet P.

After the processing of step S9, the CPU 91 makes a determination regarding distance D between the surface of the paper sheet P and the nozzle surface 11*a*, based on the output signal of the light-receiving element 7*b*, and determines whether or not the distance D is less than a predetermined distance Dx (S10). Specifically, in a case that an A/D value of the output signal of the light-receiving element 7*b* becomes greater as the distance D becomes smaller, the CPU 91 determines that the distance D is less than the predetermined distance Dx in a case that that the A/D value exceeds a threshold value.

Note that when making the determination regarding the distance D, it is allowable either to stop or not to stop the movement of the carriage 2. For example, in such a case that the velocity V of the carriage 2 is high and that the nozzle 11*a* might be heavily damaged if the carriage 2 were moved in a state that the paper sheet P makes contact with the nozzle surface 11*a*, it is allowable to stop the movement of the carriage 2. In contrast, in such a case that the velocity V of the carriage 2 is low and that the nozzle 11*a* might be damaged only lightly even if the carriage 2 were moved in a state that the paper sheet P makes contact with the nozzle surface 11*a*, it is allowable not to stop the movement of the carriage 2.

In a case that the distance D is less than the predetermined distance Dx (S10: YES), the CPU 91 proceeds to the processing of step S7.

In a case that the distance D is not less than the predetermined distance Dx (S10: NO), the CPU 91 controls the carriage motor 25 via the ASIC 94 to thereby move the carriage 2 with the carriage mover 2*m*, thereby arranging the carriage 2 at a position at which the light-emitting element 7*a* of the optical sensor 7 faces the detection-target part 3*s* of the platen 3 in the perpendicular direction (S11).

After the CPU 91 determines that the distance D is not less than the predetermined distance Dx, the CPU 91 may stop the driving of the optical sensor 7 via the ASIC 94. Further, the CPU 91 may allow the discharging operation to continue, and may cause the carriage 2 to stop in a case that the carriage 2 is arranged at the position at which the light-emitting element 7*a* of the optical sensor 7 faces the detection-target part 3*s* of the platen 3 in the perpendicular direction; and then the CPU 91 may drive the optical sensor 7.

After the processing of step S11, the CPU 91 determines whether or not the platen 3 is located at the second supporting position, based on the output signal output by the light-receiving element 7*b* after receiving the light reflected by the detection-target part 3*s* (S12). Specifically, in a case that an A/D value of the output signal of the light-receiving element 7*b* becomes smaller as the platen 3 approaches closer to the second supporting position from the first supporting position, the CPU 91 determines that the platen 3 is located at the second supporting position in a case that that the A/D value is less than the threshold value.

In a case that the platen 3 is located at the second supporting position (S12: YES), the CPU 91 proceeds to the processing of step S7.

In a case that the platen 3 is not located at the second supporting position (S12: NO), the CPU 91 stops the driving of the optical sensor 7 via the ASIC 94 (S13).

After the processing of step S13, the CPU 91 determines whether or not the recording with respect to the paper sheet P is to be ended (S14).

In a case that image data which has not been recorded yet remains in the RAM 93, the CPU 91 determines that the recording with respect to the paper sheet P is not to be ended (S14: NO), and returns to the processing of step S5.

In a case that image data which has not been recorded yet does not remain in the RAM 93, the CPU 91 determines that the recording with respect to the paper sheet P is to be ended (S14: YES), and ends this routine. In this situation, the CPU 91 controls the conveyance motor 45 via the ASIC 94 to stop the conveyance of the paper sheet P, and controls the carriage motor 25 via the ASIC 94 to return the carriage 2 to the home position.

In a case that the predetermined condition (namely, the condition not allowing the lowering in the velocity of the carriage 2 to easily occur, even if the paper sheet P makes contact with the nozzle surface 11*a*) is satisfied (S5: YES), the CPU 91 drives the optical sensor 7 via the ASIC 94 (S15), similarly to the processing of step S9.

After the processing of step S15, the CPU 91 makes the determination regarding the distance D between the surface of the paper sheet P and the nozzle surface 11*a*, based on the output signal of the light-receiving element 7*b*, and determines whether or not the distance D is less than a predetermined distance Dx (S16), similarly to step S10.

In a case that the distance D is less than the predetermined distance Dx (S16: YES), the CPU 91 proceeds to the processing of step S7. In a case that the distance D is not less than the predetermined distance Dx (S16: NO), the CPU 91 controls the carriage motor 25 via the ASIC 94 to thereby move the carriage 2 with the carriage mover 2*m*, thereby arranging the carriage 2 at a position at which the light-emitting element 7*a* of the optical sensor 7 faces the detection-target part 3*s* of the platen 3 in the perpendicular direction (S17), similarly to step S11.

After the processing of step S17, the CPU 91 determines whether or not the platen 3 is located at the second supporting position, based on the output signal output by the light-receiving element 7*b* after receiving the light reflected by the detection-target part 3*s* (S18), similarly to the processing of step S12.

In a case that the platen 3 is located at the second supporting position (S18: YES), the CPU 91 proceeds to the processing of step S7. In a case that the platen 3 is not located at the second supporting position (S18: NO), the CPU 91 stops the driving of the optical sensor 7 via the ASIC 94 (S19), similarly to the processing of step S13.

After the processing of step S19, the CPU 91 determines whether or not the velocity V is less than the predetermined velocity Vx (S20), similarly to the processing of step S8. In a case that the velocity V is not less than the predetermined velocity Vx (S20: NO), the CPU 91 proceeds to the processing of step S14. In a case that the velocity V is less than the predetermined velocity Vx (S20: YES), the CPU 91 proceeds to the processing of step S7.

As described above, according to the present embodiment, in a case that the CPU 91 determines that the velocity V is less than the predetermined velocity Vx (S8: YES) and that the distance D is less than the predetermined distance Dx (S10: YES), the CPU 91 interrupts the recording (S7). Namely, the CPU 91 makes the determination regarding the presence or absence of the contact made by the paper sheet P with respect to the nozzle surface 11*a,* based not on only the velocity V or the distance D, but based on both of the velocity V and the distance D. With this, it is possible to make the determination regarding the absence or presence of contact made by the paper sheet P with respect to the nozzle surface 11*a* with high precision, and to suppress such a problem that the recording is unnecessarily interrupted.

After the CPU 91 determines that the velocity V is less than the predetermined velocity Vx (S8: YES), the CPU 91 drives the optical sensor 7 (S9) and makes the determination regarding the distance D (S10). Namely, the optical sensor 7 is not driven in a case that the velocity V is not less than the predetermined velocity Vx. Accordingly, it is possible to realize an optical sensor 7 which has a long service life and power-saving feature.

In the present embodiment, the optical sensor 7 corresponds to a "distance sensor". Since the optical sensor 7 suffers no degradation due to being driven, as compared with another sensor (for example, a contact-type sensor having a driving part), and is capable of suppressing the power consumption, thus making it possible to enhance the long-life and power-saving feature, etc., in the sensor.

In a case that the CPU 91 determines that the velocity V is less than the lower limit value Vmin (S6: YES), the CPU 91 interrupts the recording (S7), without making the determination regarding the distance D (without performing the processing of step S10). After the CPU 91 determines that the velocity V is not less than the lower limit value Vmin and that the velocity V is less than the predetermined velocity Vx (S6: NO, then S8: YES), the CPU 91 drives the optical sensor 7 (S9) and makes the determination regarding the distance D (S10). Namely, in a case that the velocity V is less than the lower limit value Vmin, the CPU 91 determines that there is a very high possibility that the paper sheet P makes contact with the nozzle surface 11*a,* and the CPU 91 interrupts the recording without making the determination regarding the distance D. With this, in a case that the paper sheet P makes contact with the nozzle surface 11*a,* the recording is interrupted quickly, thereby making it possible to suppress, in an ensured manner, any problem (such as any jamming of paper, any damage to the nozzle(s) 11*n*, etc.,) which would be otherwise caused due to the contact made by the paper sheet P with respect to the nozzle surface 11*a*.

In a case that the predetermined condition is satisfied (S5: YES), before the CPU 91 makes the determination regarding the velocity V (S20), the CPU 91 drives the optical sensor 7 (S15) and makes the determination regarding the distance D (S16). There is such a case that even if the paper sheet P makes contact with the nozzle surface 11*a,* the lowering of the velocity V is less likely to occur. In such a case, if such a flow that the velocity V is firstly determined and then the distance D is determined after the determination has been made that the velocity V is less than the predetermined velocity is adopted, such a problem may arise that even if the paper sheet P makes contact with the nozzle surface 11*a* in a period during which the velocity V is being determined, the velocity is not determined as being less than the predetermined velocity Vx and thus the recording is not interrupted, which in turn might allow the problem due to the contact made by the paper sheet P with respect to the nozzle surface 11*a* (any jamming of paper, any damage to the nozzle(s) 11*n,* etc.) to occur. The present configuration is capable of suppressing the occurrence of the above-described problem.

In a case that the CPU 91 determines that the velocity V is less than the predetermined velocity Vx (S8: YES) and determines that the distance D is not less than the predetermined distance Dx (S10: NO), the CPU 91 makes the determination regarding the position of the platen 3 based on the output of the optical sensor 7 (S12). Then, in a case that the CPU 91 determines that the platen 3 is located at the second supporting position during the recording (S12: YES), the CPU 91 interrupts the recording (S7). The inventor of the present disclosure found out (obtained a knowledge) that in a case that the paper sheet P makes contact with the nozzle surface 11*a* or the member 10 in the vicinity of the nozzle surface 11*a,* the pressing force of the paper sheet P acts on the platen 3, thereby causing the platen 3 to move from the first supporting position to the second supporting position against the urging force of the coil spring 3 (see FIG. 4). Accordingly, after the determinations regarding the velocity V and the distance D are made, the determination regarding the position of the platen 3 is further made; in a case that the platen 3 is located at the second supporting position, the recording is interrupted. With this, it is possible to make the determination regarding the presence or absence of the contact made by the paper sheet P with respect to the nozzle surface 11*a* or the member 10, thereby making it possible to suppress the problem associated with the above-described contact (for example, any jamming of paper, any damage to the nozzle surface 11*a,* etc.,) in a more ensured manner The CPU 91 causes, in the conveying operation, at least one of the pair of upstream rollers 41 and the pair of downstream rollers 42 in a state that the at least one of the pair of upstream rollers 41 and the pair of downstream rollers 42 hold the paper sheet P therebetween. Although the jamming is particularly likely to occur in the conveyor 4 of the roller type, the present embodiment makes the determination regarding the presence or absence of the contact made by the paper sheet P with respect to the nozzle surface 11*a*, and causes the recording to be interrupted at an appropriate timing, thereby making it possible to suppressing the occurrence of jamming In a case that the CPU 91 interrupts the recording (S7), the CPU 91 stops the conveying operation. If the conveying operation is performed in a state that the paper sheet P makes contact with the nozzle surface 11*a,* the nozzle surface 11*a* is abraded thereby, leading to a severe damage to the nozzle surface 11*a*. According to the present embodiment, it is possible to suppress the above-described problem.

In a case that the CPU 91 interrupts the recording (S7), the CPU 91 stops the discharging operation. If the discharging operation is performed in a state that the paper sheet P makes contact with the nozzle surface 11*a,* the nozzle surface 11*a* is abraded thereby, leading to a severe damage to the nozzle surface 11*a*. According to the present embodiment, it is possible to suppress the above-described problem.

In a case that the CPU 91 interrupts the recording (S7), the CPU 91 causes the alarm 8 to perform the notification. In this case, it is possible to notify the user to prompt the user to perform an appropriate measure.

<Modification>

Although the embodiment of the present disclosure has been explained in the foregoing, the present disclosure is not limited to or restricted by the above-described embodiment; it is allowable to make a various kind of design changes to the present disclosure, within the scope described in the claims.

In the above-described embodiment, after the controller 9 determines that the velocity V of the carriage 2 is less than the predetermined velocity Vx (S8: YES), the controller drives the optical sensor 7 (distance sensor, position sensor) (S9), and performs the determination regarding the distance D (S10) and/or the determination regarding the position of the platen 3 (supporting member) (S12), based on the output of the optical sensor 7 made after the driving of the optical sensor 7. The present disclosure, however, is not limited to this. For example, it is allowable that the controller 9 drives the distance sensor before making the determination regarding the velocity, and that after the controller determines that the velocity is less than the predetermined velocity, the controller makes the determination regarding the distance and/or the position of the supporting member, based on the output of the distance sensor which has been made at a point of time before the determination of the velocity. Alternatively, it is allowable that after the controller 9 determines that the velocity is less than the predetermined velocity, the controller makes the determination regarding the distance and/or the position of the supporting member, based on the output of the distance sensor which is made at an arbitrary point of time after the determination of the velocity (for example, in a case that the controller 9 performs the conveying operation and the discharging operation alternately during the recording, based on the output made at a point of time at which certain discharging operation is performed concurrently with the determination of the velocity or another discharging operation after the certain discharging operation has been performed). For example, with respect to a plurality of discharging operations performed a plurality of times with respect to one medium, it is allowable to make the determination regarding position of the supporting member in a discharging operation which is included in the plurality of discharging operations and in which a margin (border) in the moving direction is the smallest; alternatively, it is allowable to make the determination regarding position of the supporting member at a period of time during which flushing is performed toward the surface of the supporting member during the recording.

The velocity sensor is not limited to or restricted by the linear encoder; it is allowable, for example, the velocity sensor is a rotary encoder configured to output a signal indicating the number of rotations (rotation rate) of the carriage motor 25, a publicly known electrical current sensor, etc.

The light-emitting element of the distance sensor (position sensor) is not limited to or restricted by being configured to irradiate the light in a direction toward the surface of the supporting member from the nozzle surface, and may be, for example, configured to irradiate the light in another direction crossing the above-described direction. Further, the light-receiving element of the distance sensor (position sensor) is not limited to or restricted by being arranged, relative to the surface of the supporting member, at a position in a direction toward the nozzle surface from the surface of the supporting member. For example, it is allowable that the light-emitting element and the light-receiving element of the distance sensor (position sensor) are arranged to sandwich the supporting member therebetween in the moving direction of the carriage.

In the embodiment, although the distance sensor (position sensor) is arranged upstream in the conveyance direction relative to all the nozzles formed in the nozzle surface, there is no limitation to this. For example, it is allowable that a part of the nozzles formed in the nozzle surface is arranged upstream in the conveyance direction relative to the distance sensor (position sensor); alternatively, it is allowable that the distance sensor (position sensor) is arranged downstream in the conveyance direction relative to all the nozzles formed in the nozzle surface.

The distance sensor (position sensor) is not being limited to or restricted by being provided on the carriage. It is allowable, for example, that the distance sensor (position sensor) is provided on the head, a casing of the liquid discharge apparatus, etc. The distance sensor provided on the casing of the liquid discharge apparatus may irradiate a light onto the surface of the recording medium, or the surface of the supporting member, during the recording.

The number of the distance sensor (position sensor) is not limited to or restricted by 1 (one). For example, in a case that the liquid discharge head is configured to discharge liquids of a plurality of colors, it is allowable that the distance sensor or position sensor is provided for each of the colors.

The distance sensor is not limited to or restricted by being a sensor of the optical system. The distance sensor may be an ultrasonic sensor, etc. Further, the distance sensor is not limited to or restricted by being a non-contact type sensor, and may be a contact-type sensor.

The characteristic of the distance sensor is not limited to or restricted by being such a characteristic that as the A/D value of the output signal becomes greater as the distance D becomes smaller; the characteristic of the distance sensor may be such a characteristic that as the A/D value of the output signal becomes smaller as the distance D becomes smaller. Further, in the present embodiment as described above, although the A/D value of the output signal changes depending on the distance D, there is no limitation to this. It is allowable that an arbitrary element of the output signal (for example, a wavelength of the output signal) may change. In such a case, the controller may make the determination regarding distance D based on the change in the arbitrary element as described above. The output of the distance sensor may include data in which the distance D is digitized.

It is allowable that there is a case that the distance sensor performs the output and a case that the distance sensor does not perform the output, depending on the distance D. In such a case, it is allowable that the controller 9 makes the determination regarding the distance D based on the presence or absence of the output from the distance sensor. For example, the distance sensor may be a contact type sensor arranged between the nozzle surface and the surface of the supporting member. In a case that the distance D is not less than the predetermined distance Dx, the medium does not make contact with the contact type sensor and the contact type sensor does not perform the output. In a case that distance D is less than the predetermined distance Dx, the medium makes contact with the contact type sensor and the contact type sensor performs the output.

In the above-described embodiment, although one sensor (optical sensor) functions both as the distance sensor and the position sensor, there is no limitation to this. It is allowable to provide a sensor functioning as the distance sensor and a sensor functioning as the position sensor, individually.

The characteristic of the position sensor is not limited to or restricted by being such a characteristic that the A/D value of the output signal becomes smaller as the supporting member approaches more closely to the second supporting position from the first supporting position; the characteristic of the position sensor may be such a characteristic that the A/D value of the output signal becomes greater as the supporting member approaches more closely to the second supporting position from the first supporting position. Further, in the above-described embodiment, although the A/D value of the output signal changes depending on the position of the supporting member, there is no limitation to this. It is allowable that an arbitrary element of the output signal (for example, a wavelength of the output signal) may change depending on the position of the supporting member. In such a case, the controller may make the determination regarding position of the supporting member based on the change in the arbitrary element as described above. The output of the distance sensor may include data in which the position of the supporting member is digitized.

It is allowable that there is a case that the position sensor performs the output and a case that the position sensor does not perform the output, depending on the position of the supporting member. In such a case, it is allowable that the controller 9 makes the determination regarding the position of the supporting member based on the presence or absence of the output from the position sensor. For example, the position sensor may be a contact type sensor arranged at a location at which the position sensor faces the back surface of the supporting member. In a case that the supporting member is located at the first supporting position, the supporting member does not make contact with the contact type sensor and the contact type sensor does not perform the output. In a case that the supporting member is located at the second supporting position, the supporting member makes contact with the contact type sensor and the contact type sensor performs the output.

The first supporting position and the second supporting position are not limited to or restricted by being the ends, respectively, in a movable range of the supporting member. For example, in the above-described embodiment, although the upper limit position in the movable range of the supporting member is the "first supporting position" with respect to a normal paper sheet P, and the lower limit position in the movable range of the supporting member is the "second supporting position", there is no limitation to this. It is allowable that a position which is between the upper limit position and the lower limit position in the movable range of the supporting member and which is rotated clockwise to a some extent from the upper limit position in FIG. 3 may be a "first supporting position" with respect to the normal paper sheet P, and that a position further rotated clockwise in FIG. 3 relative to this clockwise rotated position may be a "second supporting position".

In the above-described embodiment, although a portion, of the paper sheet P, which is deformed due to the jamming makes contact with the member 10 in the vicinity of the nozzle surface 11*a* is described as an example in which the pressing force of the medium acts on the supporting member (see FIG. 4), there is no limitation to this. For example, also in an example wherein the portion of the paper sheet P which is deformed due to the jamming makes contact with the nozzle surface 11*a*, the pressing force of the paper sheet P similarly may act on the platen 3, which in turn may cause the platen 3 to move from the first supporting position to the second supporting position. It is allowable that a spur roller is attached to the member 10. Further, the member 10 is not limited to or restricted by being the member configured to guide the paper sheet P, and may be a member constructing the carriage mover 2*m* (for example, a part or portion of the guide rail 2*b*), a frame supporting a head of the line system, etc.

The detection-target part may be formed of a same material which is same as that forming another part, in the supporting member, which is different from the detection-target part, or may be formed of a different material which is different from that forming the another part. The detection-target part may be formed integrally with, or formed as a separate member from, the another part in the supporting member which is different from the detection-target part. The detection-target part may have a light reflectance higher than the light reflectance of the another part in the supporting member different from the detection-target part (for example, the another part in the supporting member different from the detection-target part may be of black color, and the detection-target part may be of white color).

The supporting member is not limited to or restricted by being configured to be rotatable about a shaft, and may be, for example, configured to be movable in the orthogonal direction while a surface in the supporting member supporting the medium maintains a parallel state with respect to the nozzle surface. Alternatively, the supporting member may be immovable.

The surface in the supporting member facing the nozzle surface is not limited to or restricted by having the ribs, and may have a flat part. In such a case, the medium is supported by the flat part in this surface of the supporting member.

In the above-described embodiment, although the pair of upstream rollers and the pair of downstream rollers are driven at a same time by one conveyance motor, there is no limitation to this. For example, it is allowable that conveyance motors are provided respectively for the pair of upstream rollers and the pair of downstream rollers, and the pair of upstream rollers and the pair of downstream rollers may be driven independently from each other by the conveyance motors, respectively.

The conveyor is not limited to or restricted by the conveyor of the roller system, and may be a conveyor of a belt system including a belt which runs while supporting the medium.

The conveyance direction is not limited to or restricted by being orthogonal to the moving direction; the conveyance direction may cross the moving direction. In the above-described embodiment, although the conveyance direction is linear, the conveyance direction may be curved or bent.

In the above-described embodiment, although the controller 9 includes the CPU and the ASIC, there is no limitation to this. For example, it is allowable that the controller 9 includes only the CPU or ASIC, or that the controller 9 includes a plurality of pieces of the CPU and/or a plurality of pieces of the ASIC.

The processing which is performed by the controller in a case that the controller interrupts the recording is not limited to the stopping of the conveying operation, the stopping of the discharging operation, and the performing of notification; it is allowable, for example, that the processing is a processing of adjusting the distance between the medium and the nozzle surface and/or a processing of adjusting the position of the supporting member, etc.

In the above-described embodiment, the piezoelectric actuator is exemplified as the actuator configured to apply the energy for discharging the liquid from the nozzles. However, there is no limitation to this. The actuator may be an actuator of another system (for example, a thermal actuator using a heating element, a electrostatic actuator using the electrostatic force, etc.).

The liquid discharged from the nozzles is not limited to or restricted by the ink, and may be any liquid (for example, a treating liquid with which a component in the ink is caused to aggregate or deposit, a liquid in which metal particles are dispersed in a solvent, etc.).

The medium is not limited to or restricted by the paper sheet, and may be, for example, cloth (fabric), an electronic circuit board or substrate (a base member to be processed as a flexible printed circuit).

The present disclosure is not limited to or restricted by being applicable to a printer, and may be suitably applicable also to a facsimile machine, copying machine, a multifunction peripheral, etc.

What is claimed is:

1. A liquid discharge apparatus configured to discharge a liquid onto a medium, comprising:

a liquid discharge head having a nozzle surface in which a nozzle is opened;

a carriage mounting the liquid discharge head;

a carriage mover configured to move the carriage in a moving direction parallel to the nozzle surface;

a conveyor configured to convey the medium in a conveyance direction which is parallel to the nozzle surface and which crosses the moving direction;

a velocity sensor configured to output velocity signal in accordance with velocity of the carriage;

a distance sensor configured to output distance signal in accordance with distance between the medium and the nozzle surface in a direction perpendicular to the nozzle surface; and a controller configured to:

perform recording of an image on the medium by alternately controlling the conveyor to perform conveyance of the medium in the conveyance direction, and controlling the liquid discharge head to perform discharging of the liquid from the nozzle while the carriage moves in the moving direction;

make a determination regarding the velocity based on the velocity signal;

make a determination regarding the distance based on the distance signal; and control the liquid discharge head to interrupt the recording, in a case that the controller determines that the velocity is less than a predetermined velocity and that the distance is less than a predetermined distance.

2. The liquid discharge apparatus according to claim 1, wherein the controller is configured such that after the controller determines that the velocity is less than the predetermined velocity, the controller drives the distance sensor to make the determination regarding the distance.

3. The liquid discharge apparatus according to claim 2, wherein the distance sensor includes an optical sensor having a light-emitting element and a light-receiving element; and in a case that the controller makes the determination regarding the distance, the controller is configured to cause the light-emitting element to emit a light toward the medium, and to receive a signal based on the light received by the light-receiving element as the distance signal.

4. The liquid discharge apparatus according to claim 2, wherein in a case that the controller determines that the velocity is less than a lower limit value being lower than the predetermined velocity, the controller is configured to control the liquid discharge head to interrupt the recording without making the determination regarding the distance; and after the controller determines that the velocity is not less than the lower limit value and less than the predetermined velocity, the controller is configured to drive the distance sensor to make the determination regarding the distance.

5. The liquid discharge apparatus according to claim 1, wherein in a case that a predetermined condition is satisfied, the controller is configured to drive the distance sensor to make the determination regarding the distance, before making the determination regarding the velocity.

6. The liquid discharge apparatus according to claim 5, wherein the predetermined condition is a condition that contacting the medium with the nozzle surface is less likely causing lowering in the velocity of the carriage.

7. The liquid discharge apparatus according to claim 5, wherein the predetermined condition is one of conditions among:

a condition that a conveyance amount of the medium in one time of the conveyance is less than a threshold value of the conveyance amount;

a condition that a rigidity of the medium is less than a threshold value of the rigidity;

a condition that a thickness of the medium is less than a threshold value of the thickness;

a condition that a water content of the medium is not less than a threshold value of the water content;

a condition that an environmental temperature is not less than a threshold value of the environmental temperature; and a condition that an environmental moisture is not less than a threshold value of the environmental moisture.

8. The liquid discharge apparatus according to claim 1, further comprising:

a supporting member configured to support the medium at a position where the supporting member faces the nozzle surface, and to be arrangeable at a first supporting position and a second supporting position, a spacing distance in an orthogonal direction orthogonal to the nozzle surface between the nozzle surface and an upstream end in the conveyance direction of the supporting member is greater at the second supporting position than at the first supporting position;

an urging member configured to urge the supporting member in a direction toward the first supporting position from the second supporting position; and a position sensor configured to output a position signal in accordance with position of the supporting member, wherein in a case that the controller determines that the velocity is less than the predetermined velocity and that the distance is not less than the predetermined distance, the controller is configured to make the determination regarding the position of the supporting member based on the position signal; and in a case that the controller determines that the supporting member is arranged at the second supporting position during the recording, the controller is configured to control the liquid discharge head to interrupt the recording.

9. The liquid discharge apparatus according to claim 1, wherein the conveyor includes a pair of upstream rollers arranged upstream in the conveyance direction relative to the nozzle, and a pair of downstream rollers arranged downstream in the conveyance direction relative to the nozzle; and the controller is configured, in a case that the controller controls the conveyor to convey the medium in the conveyance direction, to control the conveyor to rotate at least one of the pair of upstream rollers and the pair of downstream rollers in a state that the at least the one of the pair of upstream rollers and the pair of downstream rollers hold the medium therebetween.

10. The liquid discharge apparatus according to claim 1, wherein in a case that the controller interrupts the recording, the controller is configured to control the conveyor to stop the conveyance of the medium in the conveyance direction.

11. The liquid discharge apparatus according to claim 1, wherein in a case that the controller interrupts the recording, the controller is configured to control the liquid discharge head to stop the discharging of the liquid from the nozzle.

12. The liquid discharge apparatus according to claim 1, further comprising an alarm, wherein in a case that the controller interrupts the recording, the controller is configured to control the alarm to perform notification.

* * * * *